United States Patent [19]

Everett

[11] Patent Number: 4,724,996

[45] Date of Patent: Feb. 16, 1988

[54] DATA CARRYING ASSEMBLY AND METHOD AND APPARATUS FOR FORMING SAME

[76] Inventor: Patrick J. Everett, 16 Highover Park, Amersham, Buckinghamshire, England, HB7 OBN

[21] Appl. No.: 783,596

[22] Filed: Oct. 3, 1985

[51] Int. Cl.[4] ..... B65D 27/06

[52] U.S. Cl. ..... 229/73; 229/68 R; 229/92.1

[58] Field of Search ..... 229/73, 92.1, 68 R

[56] References Cited

U.S. PATENT DOCUMENTS

| | | | |
|---|---|---|---|
| 1,871,774 | 8/1932 | Blum et al. | 229/92.1 |
| 1,995,183 | 3/1935 | Kovnat | 229/73 |
| 2,270,455 | 1/1942 | Lichter | 229/92.1 |
| 2,759,658 | 8/1956 | Sawdon | 229/73 |
| 2,895,664 | 7/1959 | Cone . | |
| 3,131,854 | 5/1964 | Deutschmeister | 229/73 |
| 3,184,150 | 5/1965 | Hubbard | 229/73 |
| 3,713,673 | 1/1973 | Katz | 229/68 R |
| 3,718,277 | 2/1973 | Volkert | 229/92.1 |
| 3,784,185 | 1/1974 | Katz | 229/68 R |
| 3,858,792 | 1/1975 | Volkert | 229/92.1 |
| 3,883,069 | 5/1975 | Volkert | 229/68 R |
| 3,920,267 | 11/1975 | Lyon | 229/92.1 |
| 3,941,309 | 3/1976 | Gendron | 229/92.1 |
| 3,952,942 | 4/1976 | O'Leary et al. . | |
| 3,995,808 | 12/1976 | Kehoe | 229/92.1 |
| 4,044,942 | 8/1977 | Sherwood | 229/73 |
| 4,055,294 | 10/1977 | Traise | 229/73 |
| 4,437,852 | 3/1984 | Volk, Jr. et al. | 229/92.1 |
| 4,487,360 | 12/1984 | Fisher et al. | 229/73 |

FOREIGN PATENT DOCUMENTS

| | | | |
|---|---|---|---|
| 0097421 | 5/1983 | European Pat. Off. . | |
| 498748 | 1/1939 | United Kingdom | 229/92.1 |
| 2029371 | 7/1979 | United Kingdom . | |
| 2117319 | 12/1982 | United Kingdom . | |
| 2135241 | 2/1983 | United Kingdom . | |

*Primary Examiner*—Stephen P. Garbe

*Attorney, Agent, or Firm*—Panitch Schwarze Jacobs and Nadel

[57] ABSTRACT

The invention concerns sealed mailer assemblies including return units made from individual sheets in a single production line and a method and apparatus for forming them. The sheets have their longitudinal edges glued and are then formed with a plurality of transverse folds so that the adjacent parts of the longitudinal edges are all secured together. The free transverse edge is also glued down. Tear lines are formed within the glued edges so that on removal of the edge portions several separate pieces are provided. An ink jet printing unit is provided within the production line capable of forming accurately positioned personalized information on any data carrying part of each sheet.

9 Claims, 12 Drawing Figures

DATA CARRYING ASSEMBLY AND METHOD AND APPARATUS FOR FORMING SAME

BACKGROUND OF THE INVENTION

The present invention relates to a data carrying mailer assembly and a method and apparatus for forming the same and more particularly but not exclusively to a fully sealed, multi-piece two-way mailer assembly, that is a combined mailer and return unit which, when opened, provides several separated data carrying pieces. The return unit may be in the form of either an envelope, a ready gummed panel for forming an envelope or a card.

In its preferred form the invention relates to a personalised, data carrying, mailer assembly formed from single sheets and personalised in a single continuous production line.

Mailer and return units are often employed when it is desired to present information to a large number of individuals (the primary addresses) and obtain a response from the individuals, for example order forms or requests for further information. This requires a primary envelope for sending the data to the primary addressee, data sheets to be retained by and/or returned by the primary addressee and a correctly addressed (normally to the sender) return unit.

Many proposals have been made to produce such an assembly but these are either complicated and thus expensive to produce or inadequate in the flexibility and amount of presentation of data which can be provided or they lack a return unit. For example U.S. Pat. Nos. 3,952,942 and 2,895,664 both involve the use of two separate sheets of paper in the construction of the mailer and return unit. These separate sheets must be appropriately aligned and secured together which is undesirable.

U.K. Patent Specifications Nos. 2135241 and 2117319 each provide a two-way envelope assembly formed from a single sheet but no separate data bearing panels so that the primary envelope needs to be manually stuffed with additional data-bearing sheet or sheets.

U.K. Patent Specification No. 2029371 discloses a primary sealed mailer formed by making two folds in a single sheet and securing the edges; when three edge marginal portions are separted this provides both a single and a double panel data bearing piece but no return unit.

European Patent Specification No. 0,097,421 discloses a sealed mailer with a return unit but only a single data sheet is provided on the initial opening of the mailer. The assembly is formed from a continuous web by a single fold along the longitudinal centre line and can thus use only a standard width of continuous web paper with limited adaptability to provide more folds or larger maximum dimension.

It is highly desirable that the data panels as well as the primary mailing unit bear information personal to each addressee, for example besides the name and address of the addressee on the primary mailer, it is desirable to have his name or promotional literature within the body of the text and for example a code such as a personal number for computer handling of returned forms or entry in a prize draw. To data such personalisation on a production line using individual sheets has been limited to providing a name and address within a relatively large area where accuracy is not required or personalisation has been possible over only a limited area of a continuous web production line. Where accurately located pesonalisation has been achieved it has been on a separate production line from that producing the mailer assembly. It has not been possible to produce accurately located personalisation of data at selected positions on individual sheets passing through a production line for forming a mailer assembly.

One object of the present invention is to provide personalised mailer assemblies which are made and personalised in a single production line from single separate sheets of material. Another object is to provide multi-piece, sealed, two-way mailer assemblies which are made by folding and glueing from single separate sheets of material on a single production line.

A further object is to provide a method and apparatus for making a multi-piece, fully sealed, two-way mailer assembly which preferably includes an adaptable ink jet printer in the production line for personalisation.

A further object is to provide a method and apparatus for making a multi-piece return mailer assembly in which the number and size of pieces provided when the mailer is opened is easily varied by varying the number and size of roll folds, thus giving easy adaptability without varying the whole production process.

Further and other objects and advantages of the invention will be apparent from the following description.

SUMMARY OF THE INVENTION

In one aspect the invention provides a mailer assembly formed by folding and glueing an individual preprinted sheet having longitudinal and transverse edges, the sheet having at least six parts, adjacent parts being connected by fold lines extending transversely between the longitudinal edges, the sheet being folded along at least five of such fold lines to form a folded formation in which parts between the fold lines overlie one another such that longitudinal edges of each part are adjacent the longitudinal edges of at least one other such part, adhesive securing means adapted to secure together at least two of such parts to form a return unit, further adhesive securing means securing together all said adjacent longitudinal edges and tear lines formed along three edges of the folded assembly inside the further securing means and extending through all the parts at such edges.

In a preferred form the invention provides a personalised data carrying assembly formed in a single continuous production line from an individual sheet having longitudinal edges and having panels preprinted with data and separated by transverse marginal portions, the sheet having at least three transverse folds extending across the sheet between the longitudinal edges and defining at least four parts which overlie one another, two of the parts connected by one of the folds forming a return unit, adhesive securing means securing together overlying portions of the longitudinal, tear lines formed along two edges of the folded assembly inside the securing means, and a third tear line formed along a third edge of the folded assembly, the third edge being opposite the one fold, such that a plurality of separate pieces including the return unit are provided by tearing the folded assembly along the three tear lines.

The invention further provides a fully sealed, two-way mailer assembly formed from a single rectangular printed sheet having two longitudinal edges and two transverse edges and data carrying panels separated by transverse marginal portions, the assembly including:

a. at least three transverse roll folds extending between the longitudinal edges, the folds defining at least four parts between the folds, b. adhesive extending along at least two lines parallel to but spaced inwardly of the longitudinal edges of one panel so said one panel a return unit including one of the folds, c. first adhesive securing means securing the longitudinal edges of the parts between the folds to adjacent such other edges to form a secure folded assembly, d. second securing means securing the one of the two transverse edges to a marginal edge portion of the folded assembly opposite the one fold, e. first and second tear lines formed along lines adjacent both the longitudinal edges of the folded assembly inside the secured marginal portions and extending through all of the parts, and f. a third tear line formed on the folded assembly inside said marginal edge portion adjacent the marginal edge portion and opposite the one fold and extending through all the parts at said one edge such that by tearing along the three tear lines a plurality of separate data carrying pieces including return unit are provided.

In a further aspect the invention provides a method of forming personalised, sealed, data carrying assemblies by folding single rectangular sheets in a continuous production line, each of the sheets having transverse and longitudinal edges and a plurality of data carrying panels separated by transverse marginal portions, including the steps of:

a. feeding the sheets in succession to a conveyor means, b. registering each sheet to accurately position it, c. applying adhesive at predetermined positions to at least one panel of each sheet, d. feeding each sheet in a registered manner through a personalised, computer controlled printing assembly and accurately printing personalised data on any panel of each sheet.

e. applying adhesive along longitudinal marginal portions of each sheet, f. folding each sheet with a plurality of transverse folds so that the longitudinal marginal portions of each of the parts between the folds adhere to adjacent such parts to form a secure folded assembly, g. securing the free transverse edge marginal portion to an edge portion of the folded assembly, and h. forming tear lines along three edges of the folded assembly inside said marginal portions.

The invention also extends to apparatus for making such mailer assemblies.

Any of the embodiments of the invention may include on any of the data bearing panels additional lines of perforation or additional areas of adhesive which can be activated, for example by moisture, so that areas may be torn off and glued together or glued to other areas.

BRIEF DESCRIPTION OF THE DRAWINGS

For a fuller understanding of the invention, reference is had to the following description, given by way of example only, with reference to the accompanying drawings in which:

FIGS. 3, 5, 7, 9 and 11 show plan while.

DETAILED DESCRIPTION OF PREFERRED EMBODIMENT

Figure 1:
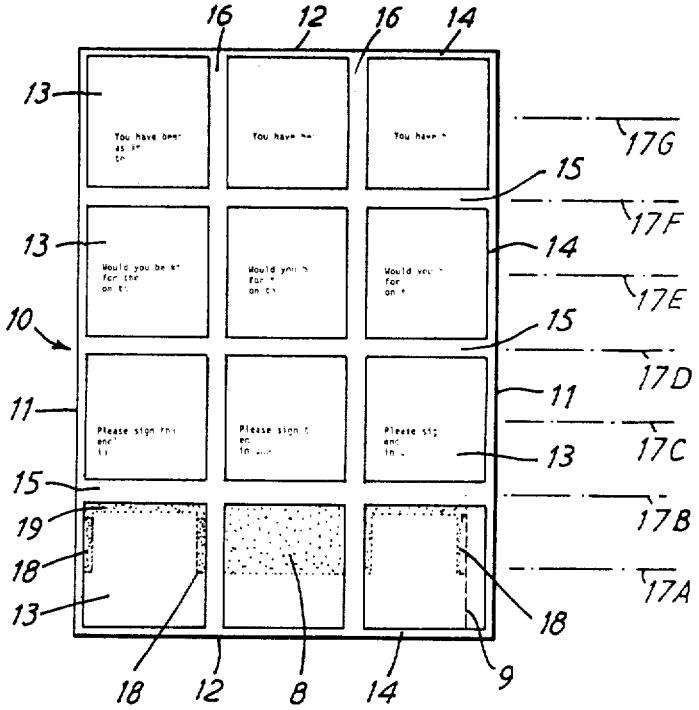
FIG. 1 is a view of one sheet showing areas which are preprinted with data and marginal blank areas, showing various glueing patterns for forming a return unit.

Referring first to FIG. 1, the mailer assemblies are made from individual rectangular sheets 10 having longitudinal and transverse edges 11, 12 respectively and separated into a plurality of panels 13 preprinted with data) by marginal edge portions 14 and transverse marginal portions 15.

In this example each sheet of paper is intended to form three separate mailer assemblies and is therefore additionally divided longitudinally by longitudinal marginal portions 16 between the assemblies. Each sheet will thus form three separate, completely sealed, mailer assemblies and each of these when opened will form a plurality of completely separate pieces each corresponding to one of the panels, at least one of these pieces being a return unit. In this example, where there are four panels in each longitudinally extending strip, there will be a return unit and three separate data carrying pieces.

To form the mailer assemblies from the sheet 10, the sheet will be roll folded with seven transverse folds along the lines indicated at 17A to G. The lower panel 13 of each assembly is used to form a return unit.

Figure 2:
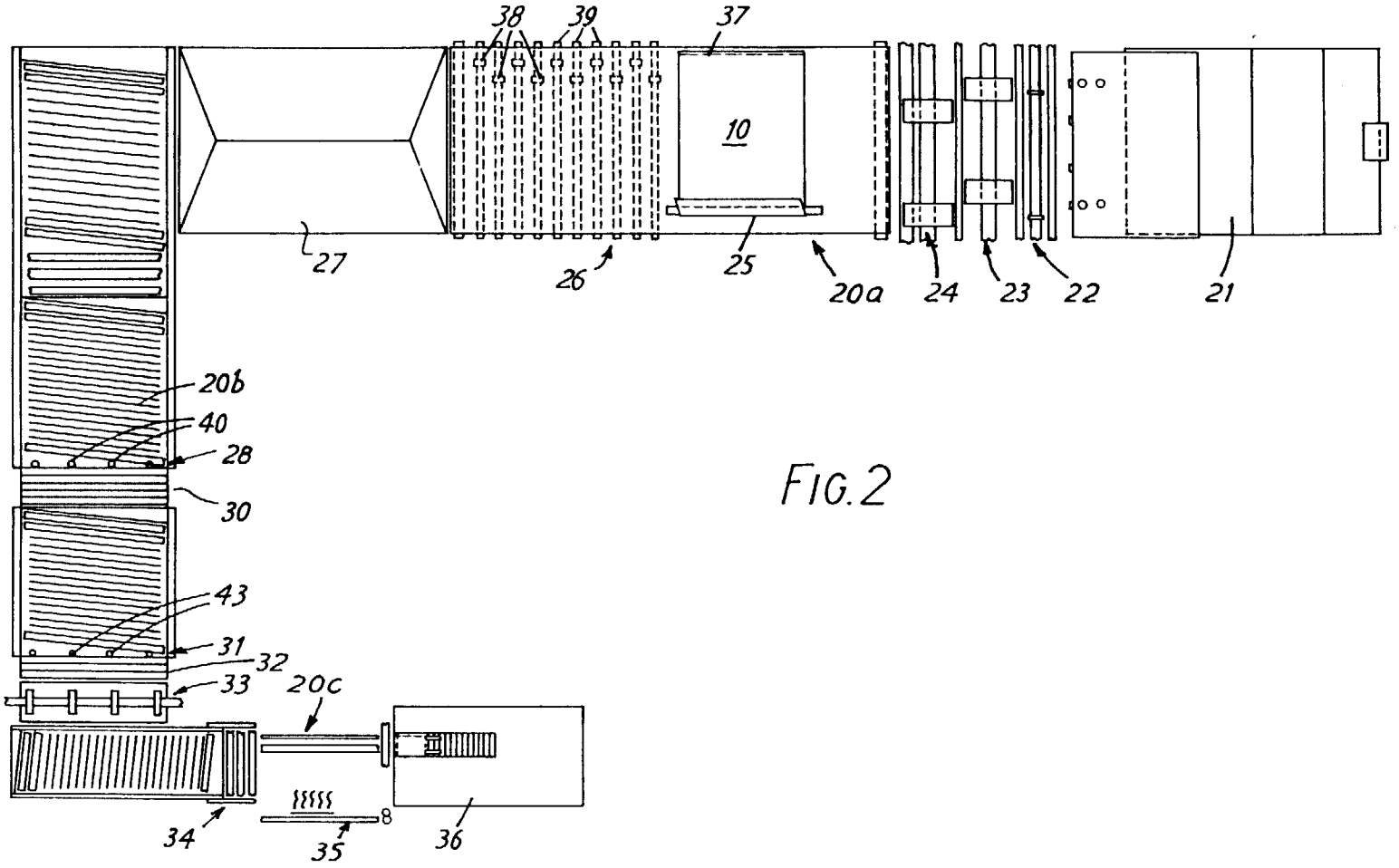
FIG. 2 is a schematic plan view of a production line for producing personalised, fully sealed, two-way mailer assemblies from separate sheets.

The production line (FIG. 2) for forming the mailer assemblies comprises a conveyor most of the rollers of which are not shown, having a first part 20*a* for conveying sheets in a direction transverse to their length, a second part 20*b* for conveying the sheets in a direction parallel to their length, and a third part 20*c* for conveying the now folded sheets in a direction opposite to the conveying direction of part 20*a*. The production line includes a conventional sheet feeder 21 arranged to feed sheets of paper individually in staggered manner to the conveyor. The feeder includes means for accurately registering the sheets with further parts of the production unit.

The conveyor conveys the sheets through the following production units in succession:

a perforating wheel unit 22, a pattern perforating unit 23, an adhesive applying unit 24, a plow fold station 25, an ink jet mounting and transport unit 26 for providing personalised printing, a radio frequency drying unit 27, a glueing unit 28, a four-plate buckle folder 30, a further glueing unit 31, a two-plate buckle folder 32, a perforating and slitter unit 33, a further perforating unit 34, a glue reactivator unit 35 and a delivery table 36.

The return unit may be in the form of a ready made envelope, an edge gummed panel where the gum is reactivatable for example by moisture, so that an envelope can be formed by the addressee or a card formed by a glued double thickness of sheet. Various alternative glueing patterns for forming the return unit are shown, by way of example, on different ones of the lower panels 13 in FIG. 1. In the left hand panel, lines of wet glue 18 are placed along the longitudinal edges of one half of the panel (by the unit 24) so that when the first inner fold along line 17A is made in the plow fold unit 25 (to the construction shown in FIG. 3) these edges are firmly stuck to provide the sides of an envelope. A remoisturable gum is applied along line 19 to provide a flap for sealing the envelope for return use. As an alternative; shown in the middle panel, a wet glue 8 is applied all over one half of the lower panel so that when the plow fold is made a double thickness card is provided. As a further alternative the lines 18 may be a remoistenable gum that is dried so that the user can make his own envelope or, as shown in the right hand lower panel 13, the lines 18 need not both be adjacent an edge of the panel but a smaller envelope unit may be provided and a line of perforation provided as indicated at 9. The part to the right of this envelope forming part could for example be one or more ready gummed, tear off stamps. The mailer could be formed with two return units.

It will be appreciated that any of the data carrying panels may be formed with gummed portions or perforations so the parts may be torn off and glued to other parts. Such perforations will be formed in the units 22, 23 while the adhesive applying unit 24 will provide the adhesive for forming the return unit and additionally will provide a line 37 of gum along the upper transverse edge, such gum being reactivatable in the reactivator unit 35 for example by heat. Any other gum required on the panels will also be applied by the gum unit 24.

The sheet 10 having the first plow fold 17A and thus the return unit formed in it, is passed to the personalising station 26 which includes means for registering the sheets accurately and has a plurality (in this example twenty) of different ink jet mounting heads 38 mounted for transverse movement along twenty rails 39, ten above and ten below the conveyor, for providing personalised printing at any position on any of the data panels. The printing is computer controlled to print accurately within any line of print of the pre-printed data so that any part of either side of any of the panels can receive personalised information.

Figure 3:
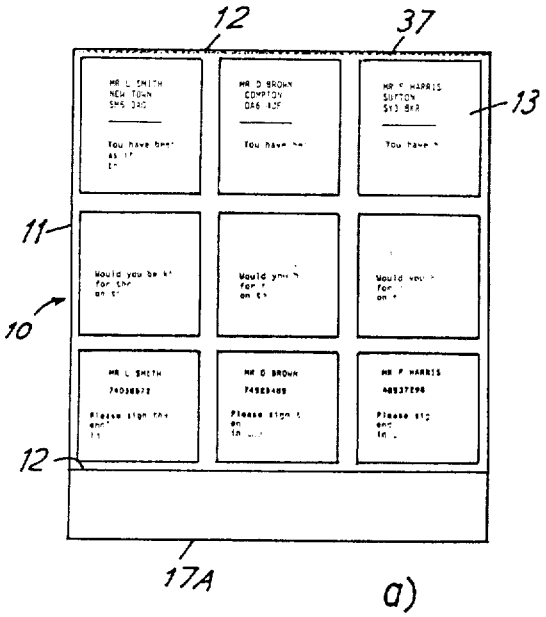
Figure 4:
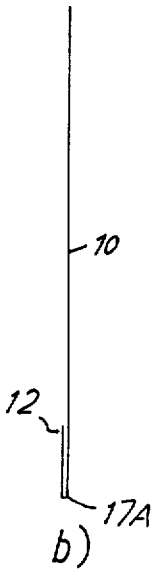
FIGS. 4, 6, 8, 10, 12, show corresponding side views respectively of a sheet at various stages of production.
Figure 5:
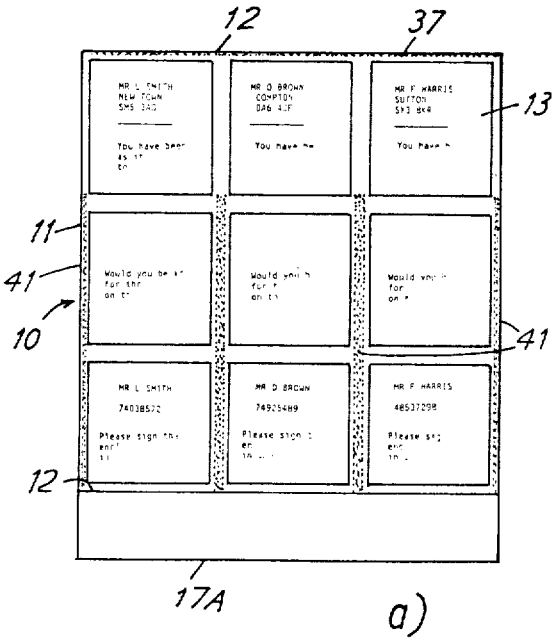
Figure 6:
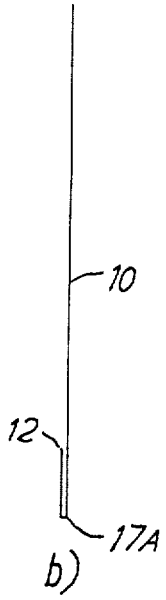
Figure 7:
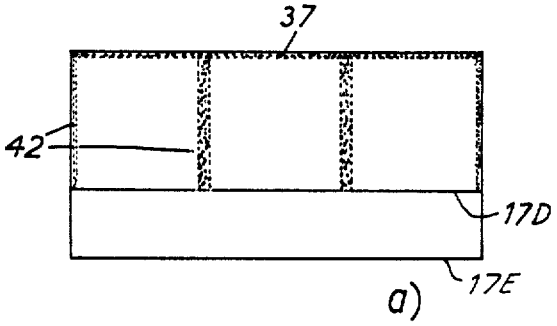
Figure 8:
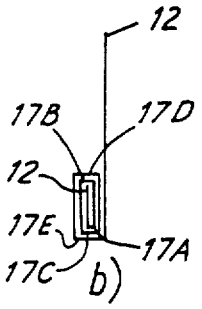
Figure 10:
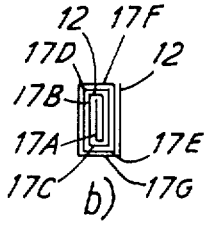

The glue and ink jet printing is dried in the dryer 27 and the sheets with one fold at 17A (as shown in FIG. 3) are then passed in the longitudinal direction past the glueing unit 28 in which strips 41 of hot melt glue are applied to the longitudinal marginal portions 16 and along the longitudinal edges 14 by nozzles 40 positioned immediately adjacent the entrance to the buckle folder 30. These strips are shown at 41 in FIG. 5 and extend for that length of the sheet which will be inside the four roll folds along lines 17B–17E formed in the folding unit 30. The glueing unit 31 then covers the remainder of the sheet length with strips of glue 42 at positions to form continuations of the strips 41 by means of nozzles 43 located immediately adjacent the entrance of the buckle folding unit 32. The sheet in the form shown in FIGS. 7 and 8 is again folded in unit 32 along lines 17F and 17G to the form shown in FIG. 10.

The hot melt glue is selected to have the required opening and closing times for the particular application so that the folded sheets issuing from the folders 30 and 32 will have all the longitudinal marginal portions between folds firmly adhered to one another. A cold glue gun system could be used as an alternative.

Figure 9:
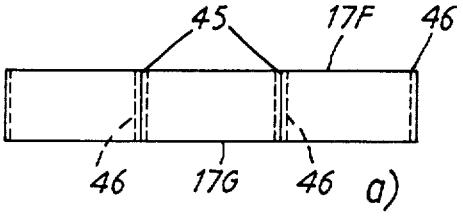
Figure 11:
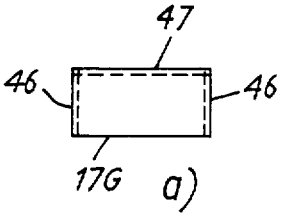
Figure 12:
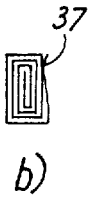

The perforating and slitting unit 33 is arranged to form slits 45 down the centres of the longitudinal marginal portions 16 and to form tear lines 46 along the longitudinal sides of each folded assembly immediately inside the glued marginal portions (FIG. 9). The perforating wheel unit 34 is arranged to form on each mailer assembly, a perforated tear line 47 (FIG. 11) along the transverse edge immediately inside the free edge 48. The reactivator unit 35 reactivates the gum along this free edge to seal it to the edge of the folded assembly (FIG. 12) and thus form a completely sealed mailer assembly including a return unit.

When the three perforated edges are torn off four separate, data carrying pieces, one of which is a return unit and any or all of which may be personalised, are provided.

By varying the number from 5 to 9 folds and the size of the folds, preferably 3 to 5 separate pieces are provided by the initial opening process and any of these may include perforations for further division.

If it is desired to leave the pieces joined together in the form of a booklet, perforations should be incorporated on one line 46 and both the opposite transverse edges 47.

Although two glueing units 28, 31 and two buckle folders are provided these may be combined into a single glueing and a single folding unit provided the glue is applied immediately before folding and has suitable opening and closing times.

What is claimed is:

1. A personalised data carrying assembly formed in a single continuous production line from an individual folded sheet having longitudinal edges and having panels preprinted with data and separated by transverse marginal portions, the sheet having at least three transverse folds extending across the sheet between the longitudinal edges and defining at least four parts which overlie one another, two of the parts connected by one of the folds forming a return unit, adhesive securing means securing together overlying portions of the longitudinal edges, tear lines formed along two edges of the folded assembly inside the securing means, and a third tear line formed along a third edge of the folded assembly, the third edge being opposite the one fold, such that a plurality of separate pieces including the return unit are provided by tearing the folded assembly along the three tear lines.

2. A fully sealed, two-way mailer assembly formed from a single rectangular printed sheet having two longitudinal edges and two transverse edges and data carrying panels separated by transverse marginal portions, the assembly including:

a. at least three transverse roll folds extending between the longitudinal edges, the folds defining at least four parts connected by the folds, b. adhesive extending along at least two lines parallel to but spaced inwardly from the longitudinal edges of one panel so said one panel forms a return unit including one of the folds, c. first adhesive securing means securing the longitudinal edges of the parts between the folds to adjacent such other edges to form a secure folded assembly, d. second securing means securing one of the two transverse edges to a marginal edge portion of the folded assembly opposite the one fold, e. first and second tear lines formed along lines adjacent both the longitudinal edges of the folded assembly inside the secured edges and extending through all the parts and f. a third tear line formed on the folded assembly inside said marginal edge portion adjacent the one transverse edge and opposite the one fold, and extending through all the parts at said marginal edge portion such that by tearing along the three tear lines a plurality of separate data carrying pieces including the return unit are provided.

3. A mailer assembly formed by folding and glueing an individual preprinted sheet having longitudinal and transverse edges, the sheet having at least six parts, adjacent parts being connected by fold lines extending transversely between the longitudinal edges, the sheet being folded along at least five of such fold lines to form a folded formation in which parts between the fold lines overlie one another such that longitudinal edges of each part are adjacent the longitudinal edges of at lesat one other such part, adhesive securing means adapted to secure together at least two of such parts to form a return unit, further adhesive securing means securing together all said adjacent longitudinal edges and tear lines formed along three edges of the folded assembly inside the further securing means and extending through all the parts at such edges.

4. A mailer assembly according to any of claims 1, 2, and 3 formed from a sheet preprinted with lines of text and which is personalised within lines of the preprinted text of a plurality of pieces thereof with information concerning an individual addressee.

5. A mailer assembly according to claim 4 which is personalised on all the pieces thereof.

6. A mailer assembly according to any of claims 1, 2 and 3 formed with at least five transverse folds.

7. A mailer according to any of claims 1, 2 and 3 formed with at least seven transverse folds.

8. A mailer assembly according to any of claims 1, 2 and 3 in which the return unit is an envelope with sealed sides and a gummed flap.

9. A mailer according to any of claims 1, 2 and 3 in which the return unit is a card of double thickness material.

* * * * *